US012163741B2

(12) United States Patent
Haik-Beraud et al.

(10) Patent No.: US 12,163,741 B2
(45) Date of Patent: Dec. 10, 2024

(54) HEAT EXCHANGER HAVING A CONFIGURATION OF PASSAGES AND IMPROVED HEAT-EXCHANGE STRUCTURES, AND COOLING METHOD USING AT LEAST ONE SUCH HEAT EXCHANGER

(71) Applicant: L'Air Liquide, Société Anonyme pour l'Etude et l'Exploitation des Procédés Georges Claude, Paris (FR)

(72) Inventors: Natacha Haik-Beraud, Champigny-sur-Marne (FR); Sophie Lazzarini, Saint Mande (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 387 days.

(21) Appl. No.: 17/632,158

(22) PCT Filed: Jul. 23, 2020

(86) PCT No.: PCT/FR2020/051345
§ 371 (c)(1),
(2) Date: Feb. 1, 2022

(87) PCT Pub. No.: WO2021/019160
PCT Pub. Date: Feb. 4, 2021

(65) Prior Publication Data

US 2022/0268528 A1 Aug. 25, 2022

(30) Foreign Application Priority Data

Aug. 1, 2019 (FR) ..... 1908806

(51) Int. Cl.
*F28D 9/00* (2006.01)
*F28F 3/02* (2006.01)

(52) U.S. Cl.
CPC ..... *F28D 9/0062* (2013.01); *F28F 3/027* (2013.01)

(58) Field of Classification Search
CPC ..... F28D 9/0092; F28F 3/027
(Continued)

(56) References Cited

U.S. PATENT DOCUMENTS 3,860,065 A * 1/1975 Schauls ..... F28F 9/02 165/166
3,992,168 A 11/1976 Toyama et al.
(Continued)

FOREIGN PATENT DOCUMENTS

EP 1 088 578 4/2001
EP 3 015 807 5/2016
(Continued)

OTHER PUBLICATIONS

Fischer, B., A new process to reduce LNG cost, ICHE Spring Meeting, Natural Gas Utilization Conference, X, US, Mar. 10, 2002, 191-202.
(Continued)

*Primary Examiner* — Claire E Rojohn, III
(74) *Attorney, Agent, or Firm* — Elwood L. Haynes

(57) ABSTRACT

A heat exchanger having multiple plates which are mutually parallel and parallel to a longitudinal direction, the exchanger having a length measured in the longitudinal direction, the plates being stacked with spacing so as to define a first series of passages for the flow, in a general flow direction parallel to the longitudinal direction, of at least a first refrigerant fluid and a second refrigerant fluid, at least one passage of the first series being defined between two adjacent plates.

10 Claims, 9 Drawing Sheets

(58) Field of Classification Search
USPC ..... 165/166
See application file for complete search history.

(56) References Cited

U.S. PATENT DOCUMENTS

| | | | | |
|---|---|---|---|---|
| 4,181,174 | A | 1/1980 | Grenier | |
| 4,330,308 | A * | 5/1982 | Grenier | F25J 5/002 165/166 |
| 4,646,822 | A | 3/1987 | Voggenreiter et al. | |
| 5,199,266 | A | 4/1993 | Johansen | |
| 5,918,368 | A * | 7/1999 | Ervin | F28D 9/0068 29/890.03 |
| 6,460,613 | B2 * | 10/2002 | Nash | F28D 9/0043 165/146 |
| 7,228,892 | B2 * | 6/2007 | Lagerstrom | F28D 9/0031 165/DIG. 387 |
| 8,327,924 | B2 * | 12/2012 | Muley | F28F 3/02 165/135 |
| 8,959,952 | B2 * | 2/2015 | Darde | F25J 3/0252 62/632 |
| 9,819,044 | B2 * | 11/2017 | De Vos | H01M 8/04074 |
| 2007/0227185 | A1 | 10/2007 | Stone et al. | |
| 2012/0012291 | A1 * | 1/2012 | Ito | F28F 9/026 165/166 |
| 2012/0067079 | A1 | 3/2012 | Sethna et al. | |
| 2015/0260451 | A1 | 9/2015 | Haberberge et al. | |
| 2018/0299210 | A1 | 10/2018 | Ronacher | |
| 2018/0356150 | A1 | 12/2018 | Chambron | |
| 2021/0164734 | A1 | 6/2021 | Haik-Beraud et al. | |

FOREIGN PATENT DOCUMENTS

| | | |
|---|---|---|
| FR | 2 563 620 | 10/1985 |
| FR | 1 857 133 | 2/2020 |
| WO | WO 2014 087225 | 6/2014 |
| WO | WO 2017 081374 | 5/2017 |
| WO | WO 2017 134353 | 8/2017 |
| WO | WO 2018 172644 | 9/2018 |

OTHER PUBLICATIONS

Onaka, M. et al., Use of plate fin heat exchangers for main cryogenic exchanger units, LNG Journal, Nelton Publications, Gravesend, GB, Jan. 1, 1997, 17-19.

Paradowski, H. et al., Experimental study of plate heat exchangers condensing and vaporizing liquefied hydrocarbon gases, GPA Technical Meeting, Feb. 1, 2001, 1-14.

Stone, J. B. et al., LNG process selection considerations for future developments, International Conference and Exhibition of Liquefied Natural Gas (LNG), Apr. 18, 2010, Oran, Algeria, vol. 16, Poster PO1-13, 1-9.

International Search Report for corresponding PCT/FR2020/051345, Nov. 3, 2020.

* cited by examiner

HEAT EXCHANGER HAVING A CONFIGURATION OF PASSAGES AND IMPROVED HEAT-EXCHANGE STRUCTURES, AND COOLING METHOD USING AT LEAST ONE SUCH HEAT EXCHANGER

CROSS REFERENCE TO RELATED APPLICATIONS

This application is a 371 of International Application No. PCT/FR2020/051345, filed Jul. 23, 2020, which claims priority to French Patent Application No. 1908806, filed Aug. 1, 2019, the entire contents of which are incorporated herein by reference.

BACKGROUND

The present invention relates to a heat exchanger comprising series of passages for the flow of multiple refrigerant fluids to be brought into heat exchange relationship with a calorigenic fluid. In particular, the exchanger according to the invention may be used in a method for liquefying a mixture of hydrocarbons such as natural gas.

The technology commonly used for an exchanger is that of brazed plate-fin exchangers made of aluminum, which make it possible to obtain very compact devices offering a large exchange surface area.

These exchangers comprise a stack of plates which extend in two dimensions, specifically length and width, thus forming a stack of vaporization passages and condensation passages, the former being intended for example for vaporizing the refrigerant liquid and the latter for condensing a calorigenic gas. It is to be noted that the exchanges of heat between the fluids can occur with or without a change of phase.

In order to introduce and discharge the fluids into and out of the exchanger, the passages are provided with fluid inlet and outlet openings. The inlets and outlets placed one above the other in the stacking direction of the passages of the exchanger are respectively joined at inlet and outlet manifolds of general semi-tubular shape, through which the fluids are distributed and discharged.

Multiple calorigenic and refrigerant fluids with distinct natures and/or characteristics can circulate in the exchanger. These fluids form separate streams or flows that are introduced into and discharged from the exchanger via groups of inlets and outlets dedicated to one type of fluid.

Conventionally, in the case in which multiple refrigerant fluids circulate in the exchanger, the inlets and outlets for the various refrigerant fluids are arranged successively, along the length of the exchanger, in increasing order of temperature starting from the cold end of the exchanger, i.e. the point of entry into the exchanger at which a fluid is introduced at the lowest temperature of all the temperatures of the exchanger.

Thus, when the outlet temperature of one refrigerant fluid is higher than the inlet temperature of a second refrigerant fluid, the second refrigerant fluid must enter the exchanger, along the length of the exchanger, at a position that is closer to the cold end than the outlet of the refrigerant fluid is.

As is known, the pinch analysis method is used to plan the manner in which the fluids in heat exchange relationship circulate in the exchanger and to maximize the energy efficiency of the facility.

The term "pinch point" refers to the minimum deviation between the temperature of the refrigerant fluids, that is to say the fluids that heat up in the exchanger, and the temperature of the calorigenic fluids, that is to say the fluids that cool down in the exchanger, which is to say at a given point of the exchanger.

The term "pinch point" refers to the minimum deviation between the temperature of the refrigerant fluids, that is to say the fluids that heat up in the exchanger, and the temperature of the calorigenic fluids, that is to say the fluids that cool down in the exchanger, which is to say at a given point of the exchanger. In order to show this pinch point, the deviation between two composite curves of an exchanged heat-temperature diagram is analyzed, as is illustrated in FIG. 5(*a*), one being associated with the flows to be heated, the other with the flows to be cooled down. As long as this minimum deviation is positive, there is theoretically a way to reduce the energy consumption.

Conventionally, in order to optimize the pinch point between the curves of the exchange diagram that originate from the pinch analysis method, at least two types of different passages for refrigerant fluid are provided, one type of passage dedicated to the circulation of a refrigerant fluid and at least a second type of passage dedicated to the circulation of the second refrigerant fluid. These passages of different types are not formed between the same pair of adjacent plates of the exchanger.

This increases the complexity of the exchanger and significantly increases the size of the exchanger. Furthermore, each type of passage then has a significant portion in which no fluid circulates, that is to say an inactive zone in terms of exchange with the calorigenic fluid.

In order to overcome these drawbacks, the applicant has proposed, in the French patent application No. 1857133, which was not yet published at the date of filing of the present application, longitudinally sharing at least one passage formed between two adjacent plates of the exchanger and circulating various refrigerant fluids therein.

More specifically, when the exchanger is in operation, multiple refrigerant fluids of different types circulate within the same passage, that is to say between the two same plates of the exchanger, in dedicated flow portions that succeed one another in the direction of extent of the passage.

This solution makes it possible to efficiently reduce the volume of the exchanger by reducing the number of cooling passages and improves the performance of the exchanger by minimizing the volume of inactive zones within the exchanger.

Also known from U.S. Pat. No. 4,330,308 is a heat exchanger for circulating various refrigerant fluids in one and the same passage.

However, certain problems continue to arise, in particular for methods in which the refrigerant fluids have relatively similar molar flow rates but are vaporized at different vaporization pressures.

In the configuration of a passage shared among multiple refrigerant fluids as explained above, the various refrigerant fluids circulate in the same exchanger section. Specifically, this section corresponds to the product of the height of the passages, the width of the passages and the number of passages of the exchanger that are dedicated to these fluids.

As a matter of fact, if the refrigerant fluids are vaporized at different vaporization pressures, they have different volumetric flow rates, in particular as they go toward the hot end of the exchanger, as the liquid refrigerant fluids vaporize.

Heat exchange structures, such as heat exchange waves, are generally disposed in the passages of the exchanger.

These structures comprise fins that extend between the exchanger plates and increase the heat-exchange surface area of the exchanger.

Conventionally, similar heat exchange structures are disposed in the various flow portions dedicated to each refrigerant fluid. Thus, in the event that the refrigerant fluids have different volumetric flow rates, they are subject to pressure losses that get smaller as the volumetric flow rates decrease. In particular, in the case of refrigerant fluids that are vaporized at different pressures and for similar molar flow rates, the refrigerant fluids vaporized at higher pressures have lower volumetric flow rates and therefore smaller pressure losses and lower flow velocities. If it is not desired to overly increase the pressure loss of the fluids vaporizing at a lower pressure so as to keep the energy consumption of the apparatus reasonable, the result is nonuniformities in the distribution of the refrigerant fluids vaporizing at a higher pressure, thereby causing the performance of the exchanger to deteriorate.

SUMMARY

The aim of the present invention is to wholly or partially solve the problems mentioned above, in particular by providing a heat exchanger in which multiple different refrigerant fluids circulate in dedicated portions within at least one common passage and which allows a more uniform distribution between said refrigerant fluids.

The solution according to the invention is thus a heat exchanger comprising multiple plates which are mutually parallel and parallel to a longitudinal direction, said exchanger having a length measured in the longitudinal direction, said plates being stacked with spacing so as to define a first series of passages for the flow, in a general flow direction parallel to the longitudinal direction, of at least a first refrigerant fluid and a second refrigerant fluid, at least one passage of the first series being defined between two adjacent plates and comprising:

- at least a first inlet configured for introducing the first refrigerant fluid into a first portion of said passage and a first outlet configured for discharging the first refrigerant fluid from the first portion,
- at least a second inlet configured for introducing the second refrigerant fluid into a second portion of said passage and a second outlet configured for discharging the second refrigerant fluid from the second portion, said first inlet, second inlet, first outlet and second outlet being arranged such that said at least one passage of the first series is divided, in the longitudinal direction, into at least the first portion and the second portion,
- a first heat exchange structure arranged in the first portion and comprising at least one series of first fluid guiding walls having first leading edges extending orthogonally to the longitudinal direction so as to entirely or partially face the first refrigerant fluid when it flows in the first portion,
- a second heat exchange structure arranged in the second portion and comprising at least one series of second fluid guiding walls having second leading edges extending orthogonally to the longitudinal direction so as to entirely or partially face the second refrigerant fluid when it flows in the second portion, characterized in that the cross-sectional area of the second leading edges is greater than the cross-sectional area of the first leading edges, said cross-sectional areas being measured orthogonally to the longitudinal direction and per meter of exchanger length.

Depending on the circumstances, the invention may comprise one or more of the following features:

- the cross-sectional area of the second leading edges corresponds to the cross-sectional area of the first leading edges multiplied by a coefficient at least equal to 1.3, preferably between 1.5 and 5.
- in that said at least one series of first fluid guiding walls and said at least one series of second fluid guiding walls respectively form at least a first corrugation and at least a second corrugation, each comprising a plurality of fins succeeding one another in a lateral direction which is orthogonal to the longitudinal direction and parallel to the plates, with wave peaks and wave troughs alternately connecting said fins.
- said first and second corrugations respectively have a first pitch and a second pitch that is smaller than the first pitch, with $p1=25.4/n1$ and $p2=25.4/n2$, $n1$ and $n2$ respectively being the number of fins per inch (1 inch=25.4 millimeters) of the first and second corrugations as measured in the lateral direction.
- the first fluid guiding walls have a first thickness and the second fluid guiding walls have a second thickness, the second thickness being greater than the first thickness.
- the second heat exchange structure comprises multiple series of second fluid guiding walls, said series succeeding one another in the longitudinal direction and each forming a second corrugation having a corrugation direction parallel to the lateral direction, each second corrugation being offset by a predetermined second distance, in the lateral direction, with respect to an adjacent second corrugation, and having a second serration length in the longitudinal direction.
- the first heat exchange structure comprises multiple series of first fluid guiding walls, said series succeeding one another in the longitudinal direction and each forming a first corrugation having a corrugation direction parallel to the lateral direction, each first corrugation being offset by a predetermined first distance, in the lateral direction, in relation to an adjacent first corrugation, and having a first serration length in the longitudinal direction.
- the second serration length is smaller than the first serration length.
- in that said first inlet, second inlet, first outlet and second outlet are arranged such that the second portion is arranged downstream of the first portion in the longitudinal direction, the first refrigerant fluid and the second refrigerant fluid flowing generally in the longitudinal direction.
- said at least one passage of the first series further comprises a third inlet configured for introducing a third refrigerant fluid into a third portion of said passage and a third outlet configured for discharging the third refrigerant fluid from the third portion, said third inlets and third outlets being arranged such that said at least one passage of the first series is divided, in the longitudinal direction, into at least the first portion, the second portion and the third portion, the third portion comprising a third heat exchange structure comprising at least one series of third fluid guiding walls having third leading edges extending orthogonally to the longitudinal direction so as to entirely or partially face the third refrigerant fluid when it flows in the third portion, the total cross-sectional area of third leading edges being greater than the total cross-sectional area of second leading edges and/or greater than the cross-sectional area of first leading edges, said total cross-sectional area being measured orthogonally to the longitudinal direction and per meter of exchanger length.

the third inlet and the third outlet are arranged such that the third portion is arranged downstream of the first portion and downstream of the second portion in the longitudinal direction, the third refrigerant fluid flowing generally in the longitudinal direction.

the second portion and/or the third portion comprise at least one additional corrugation having a plurality of fins that succeed one another in the longitudinal direction and extend orthogonally to the longitudinal direction.

According to another aspect, the invention relates to a heat exchange method that implements at least one heat exchanger according to the invention, said method comprising the following steps:

i. introducing a stream of calorigenic fluid into at least one passage of a second series of passages defined between the plates of the exchanger, ii. introducing a first refrigerant fluid via the first inlet of at least one passage of the first series, iii. discharging the first refrigerant fluid introduced in step ii) via the first outlet of said passage, iv. introducing a second refrigerant fluid via the second inlet of said passage, v. discharging the second refrigerant fluid introduced in step iv) via the second outlet of said passage, vi. said stream of calorigenic fluid exchanging heat at least with the first refrigerant fluid via the first heat exchange structure and with the second refrigerant fluid via the second heat exchange structure.

In particular, the method according to the invention may be used in a method for cooling down, or even for liquefying, a stream of hydrocarbons such as natural gas as stream of calorigenic fluid, said method implementing at least one heat exchanger according to the invention, said method comprising the following steps:

a. introducing the stream of hydrocarbons into the heat exchanger, b. introducing a first cooling stream into the heat exchanger, c. extracting from the heat exchanger at least a first partial cooling stream and a second partial cooling stream that originate from the first cooling stream, d. expanding at least the first partial cooling stream and the second partial cooling stream to at least two different pressure levels to respectively produce at least the first refrigerant fluid and the second refrigerant fluid, e. reintroducing at least some of the first refrigerant fluid into the heat exchanger via at least the first inlet of at least one passage of the first series, causing the first refrigerant fluid to flow into at least a first portion of the passage, and discharging the first refrigerant fluid via the first outlet of said passage, f. reintroducing at least some of the second refrigerant fluid into the heat exchanger via at least the second inlet of said passage, causing the second refrigerant fluid to flow into at least a second portion, and discharging the second refrigerant fluid via the second outlet of said passage, g. cooling down the stream of hydrocarbons through exchange of heat with at least the first refrigerant fluid via the first heat exchange structure and with the second refrigerant fluid via the second heat exchange structure, such that the stream of hydrocarbons is cooled down, possibly at least partially liquefied, against at least the first refrigerant fluid and the second refrigerant fluid, which at least partially vaporize.

Preferably, the first and second refrigerant fluids flow in the longitudinal direction in a generally rising manner, the second portion for the flow of the second refrigerant fluid being arranged, in the longitudinal direction, downstream of the first portion for the flow of the first refrigerant fluid, the second refrigerant fluid having a pressure which is greater than the pressure of the first refrigerant fluid.

In particular, the first refrigerant fluid is discharged from the passage at a first temperature and the second refrigerant fluid is introduced into the passage at a second temperature, the second temperature being lower than the first temperature.

The present invention can be applied to a heat exchanger that vaporizes at least two partial streams of a two-phase liquid-gas fluid as refrigerant fluids, in particular at least two partial streams of a mixture with multiple constituents, for example a mixture of hydrocarbons, through exchange of heat with at least one calorigenic fluid, for example natural gas.

In particular, the stream of hydrocarbons may be natural gas. In particular, the liquefying method is implemented in a method for producing liquefied natural gas (LNG).

The term "natural gas" refers to any composition containing hydrocarbons including at least methane. This comprises a "raw" composition (prior to any treatment or scrubbing) and also any composition which has been partially, substantially or totally treated for the reduction and/or removal of one or more compounds, including, but without being limited to, sulfur, carbon dioxide, water, mercury and certain heavy and aromatic hydrocarbons.

BRIEF DESCRIPTION OF THE DRAWINGS

The present invention will now be better understood by virtue of the following description, which is given purely by way of non-limiting example and with reference to the appended figures, in which.

DETAILED DESCRIPTION OF PREFERRED EMBODIMENTS

Figure 1:
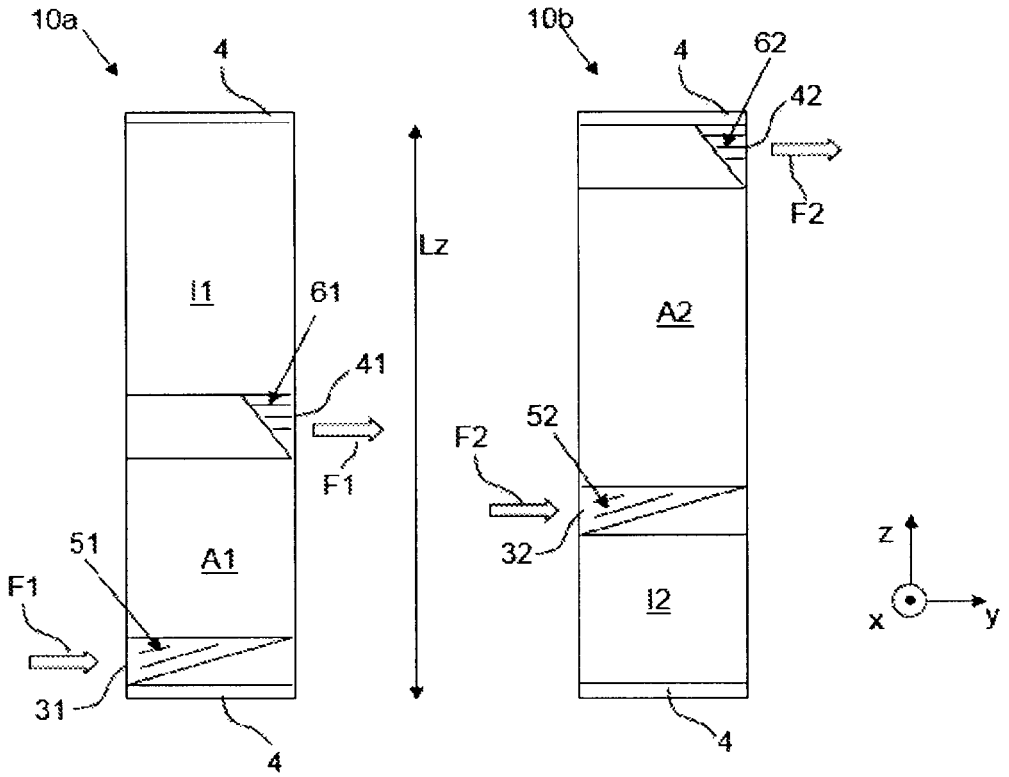
FIG. 1 is a schematic sectional view, in a plane parallel to the plates of the exchanger, of a refrigerant fluid passage of a heat exchanger according to the prior art.

Passages 10*a*, 10*b* of a heat exchanger according to the prior art are visible in FIG. 1. The exchanger comprises multiple plates 2 that extend in two dimensions, specifically length Lz and width Ly, respectively in a longitudinal direction z and a lateral direction y orthogonal to z and parallel to the plates 2.

The plates 2 are disposed in parallel one above the other with spacing in a stacking direction x, thus forming a plurality of passages for fluids in indirect heat exchange relationship via the plates. Each passage of the exchanger preferably has a parallelepipedal and flat shape. The gap between two successive plates is small compared to the length and the width of each successive plate.

FIG. 1 schematically depicts the passages of an exchanger configured for vaporizing a first refrigerant fluid F1 and a second refrigerant fluid F2 through exchange of heat with a calorigenic fluid C.

It is to be noted that the other refrigerant fluids F2, F3, etc. may be fluids having a different composition than the first refrigerant fluid F1 or else a refrigerant fluid having the same composition as the first refrigerant fluid F1 but at least one physical characteristic, in particular pressure, temperature, that is different than that of the first refrigerant fluid F1.

Figure 2:
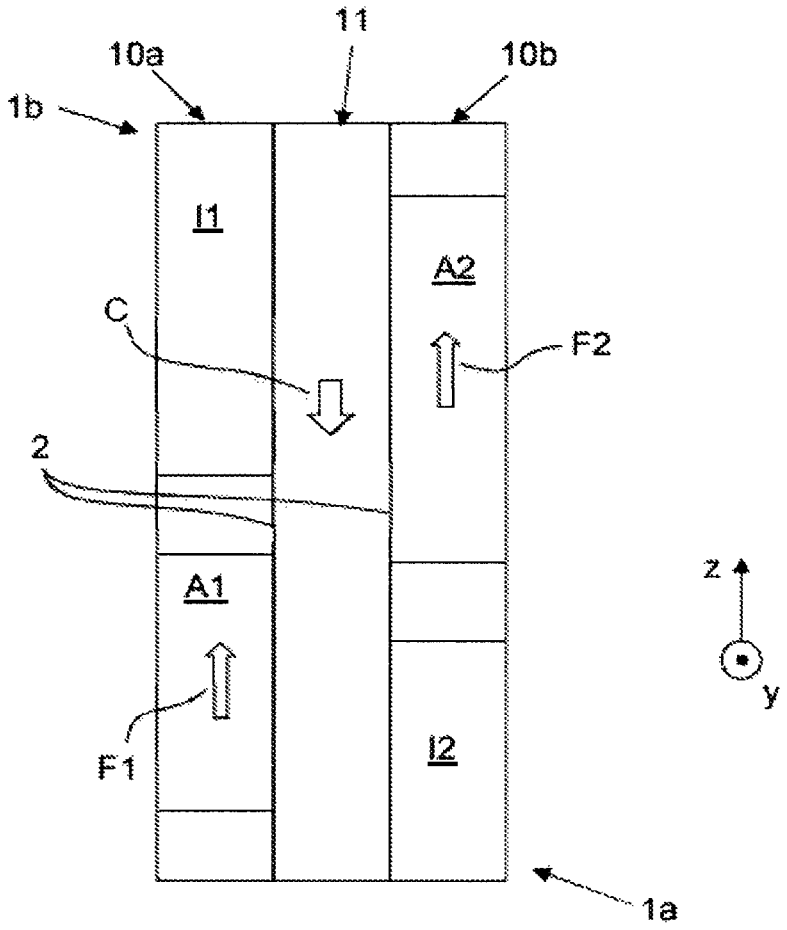
FIG. 2 is a schematic sectional view, in a plane orthogonal to the plates and parallel to the longitudinal direction of the exchanger, of series of passages of the heat exchanger of FIG. 1.

The calorigenic fluid C circulates in a second series of passages 11 (visible in FIG. 2) which are entirely or partially arranged in alternation with or adjacent to all or some of the passages 10*a*, 10*b* of the first series. The flow of the fluids in the passages occurs generally parallel to the longitudinal direction z which is preferably, as in the case illustrated, vertical when the exchanger is in operation.

The sealing of the passages 10*a*, 10*b* along the edges of the plates is generally provided by lateral and longitudinal sealing strips 4 attached to the plates. The lateral sealing strips 4 do not completely close off the passages 10*a*, 10*b* but leave fluid inlet openings 31, 32 and fluid outlet openings 41, 42.

Such an arrangement of passages according to FIG. 1 is encountered in particular in an exchanger implemented in a natural gas liquefaction method. One of the known methods for obtaining liquefied natural gas is based on the use of two cycles for cooling the natural gas respectively implementing a first and a second mixture of cooling hydrocarbons. The first cooling cycle allows the natural gas to be cooled down to its dew point using at least two different levels of expansion to increase the efficiency of the cycle. The second cycle allows the natural gas to be liquefied and subcooled and only has one level of expansion.

In the first cycle of expansion, the first cooling mixture from a compressor is subcooled in a first exchanger. At least two partial streams from the first cooling mixture are withdrawn from the exchanger at two separate exit points and then expanded to different pressure levels, thus forming at least a first and a second separate refrigerant fluid F1 and F2 that are reintroduced into the exchangers via separate inlets 31, 32 selectively supplying the passages 10*a*, 10*b* in order to be vaporized therein and then discharged via separate outlets 41, 42.

As is known, the refrigerant fluid F1 expanded to a given pressure level enters via the inlet 31 located at the cold end of the exchanger and exits via the outlet 41 at a temperature higher than the inlet temperature via the inlet 32 of the second refrigerant fluid expanded to a second pressure level.

In order to follow the arrangement of inlets and outlets in an increasing order of temperature of the fluids, the inlet of the second refrigerant fluid is located conventionally, in the longitudinal direction z, at a position closer to the cold end of the exchanger than the outlet of the lower-pressure refrigerant fluid is.

As can be seen in FIG. 1, the exchanger comprises two types of cooling passages, one 10*a* for the first refrigerant fluid F1 and the other 10*b* for the second refrigerant fluid F2. The calorigenic fluid C flowing in the passages 11 that are adjacent to the passages of one type 10*a* and/or of a second type 10*b* therefore exchanges heat at the active exchange zone A1 with the fluid F1 and at the active exchange zone A2 for the second fluid F2. The zones 11 and 12 are not supplied with fluid and therefore constitute thermally inactive zones.

In order to reduce the longitudinal extent of these inactive zones, or even to completely eliminate them, the French patent application No. 1857133 has proposed longitudinally sharing at least one passage formed between two plates 2 of the exchanger and circulating various refrigerant fluids therein.

Figure 3:
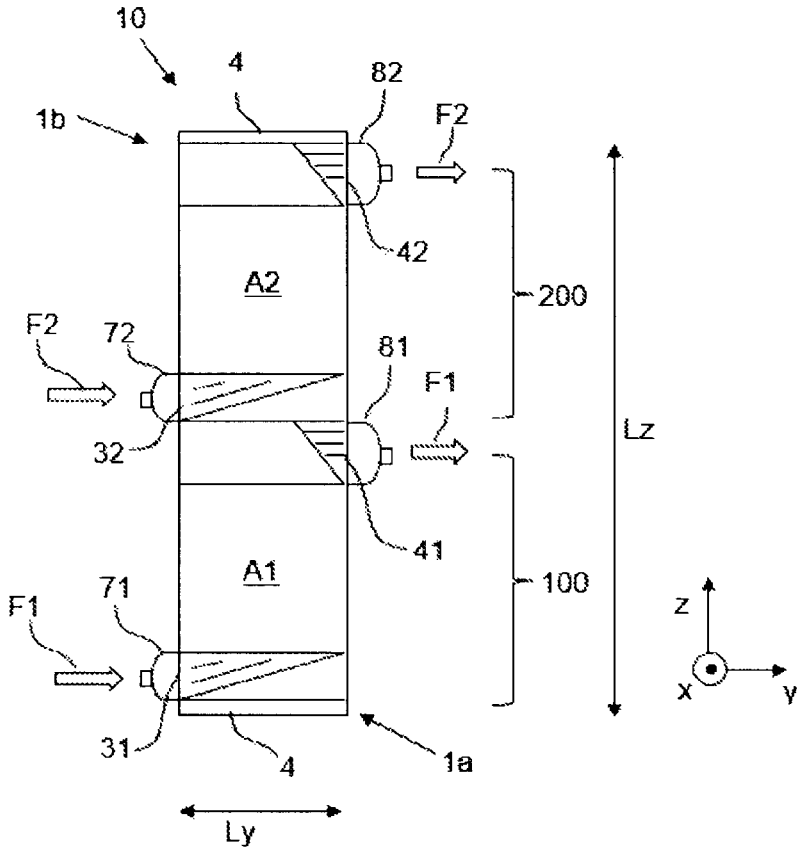
FIG. 3 is a schematic sectional view, in a plane parallel to the plates of the exchanger, of a passage of a heat exchanger according to one embodiment of the invention.

Such a passage configuration is visible in FIG. 3. What can be seen there, in a sectional plane parallel to that of FIG. 1, is a passage 10 of the first series of cooling passages comprising a second inlet 32 and a second outlet 42 for a second refrigerant fluid F2.

The first and second inlets and outlets 31, 41, 32, 42 are arranged such that the passage 10 is divided, in the longitudinal direction z, into at least a first portion 100 for the flow of the first refrigerant fluid F1 and a second portion 200 for the flow of the second refrigerant fluid F2.

This is made possible by taking into account the temperature overlaps as of the design phase of the method. In order to circulate the refrigerant fluids in the same passage, even though the outlet temperature of the first fluid is higher than the inlet temperature of the second fluid, it is necessary to simulate the exchanger not as a single section with two refrigerant fluids arriving at different temperatures, as is the case with the known pinch analysis method, but as various consecutive sections (two in the example cited), each of these sections comprising a single refrigerant fluid, arriving at its inlet temperature, in order to best approximate the actual geometry and therefore the actual pinch points that the exchanger will exhibit.

Figure 5:
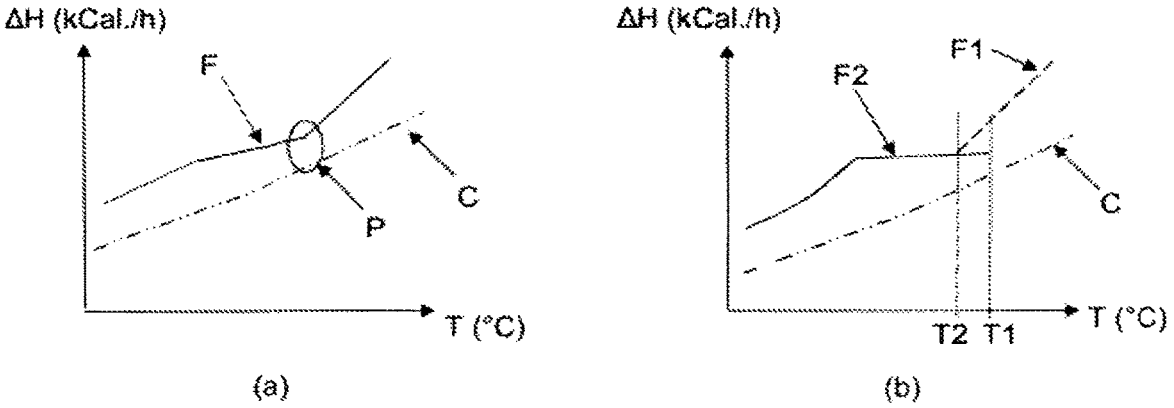
FIG. 5 shows, for the one part, the exchange diagram curves for a conventional exchanger as illustrated in FIG. 1 and, for the other part, the exchange diagram curves for an exchanger according to the invention as illustrated in FIG. 3.

This principle is illustrated in FIG. 5, which shows a comparison between the exchanged heat–temperature (ΔH–T) exchange diagrams, or enthalpy curves, obtained on the one hand with an exchanger simulated according to the conventional pinch analysis method (in (a)) and on the other hand with an exchanger in which the fluids circulate in a longitudinally shared passage (in (b)). The curves C, F, F1, F2 illustrate the evolution of the amount of heat exchanged as a function of the temperature, respectively for the calorigenic fluid, a composite refrigerant fluid created in accordance with the conventional pinch analysis method, the refrigerant fluid F1 according to the patent application No. 1857133, and the second refrigerant fluid F2 according to the patent application No. 1857133.

Conventionally, the longitudinally shared portions of the passage 10 comprise heat exchange structures S1, S2 disposed between the plates 2. The purpose of these structures is to increase the heat-exchange surface area of the exchanger. Specifically, the heat exchange structures are in contact with the fluids circulating in the passages and transfer heat flows by conduction as far as the adjacent plates.

The heat exchange structures also act as spacers between the plates 2, in particular during the assembly of the exchanger by brazing, and to avoid any deformation of the plates when pressurized fluids are being used. They also guide the flows of fluid in the passages of the exchanger.

For convenience, it is conventional to arrange heat exchange structures S1, S2 of the same type in the portions 100, 200. For example, when these structures are formed by waves, they have corrugations of the same type, in particular the same corrugation period and therefore the same fin density, the same thickness, etc.

However, the inventors of the present invention have shown that with such a configuration, disparities in the pressure losses and flow velocities appear between the various types of refrigerant fluids, in particular due to the various pressures at which these fluids circulate in the various portions of the passage 10.

In order to solve these problems, the invention provides for the arrangement, in an exchanger having at least one longitudinally shared passage according to the principles described in the patent application No. 1857133, of heat exchange structures that balance the pressure losses between the various passage portions in question.

More specifically, at least one passage 10 is divided into at least a first and a second portion 100, 200 respectively comprising a first and a second heat exchange structure S1, S2.

Figure 7:
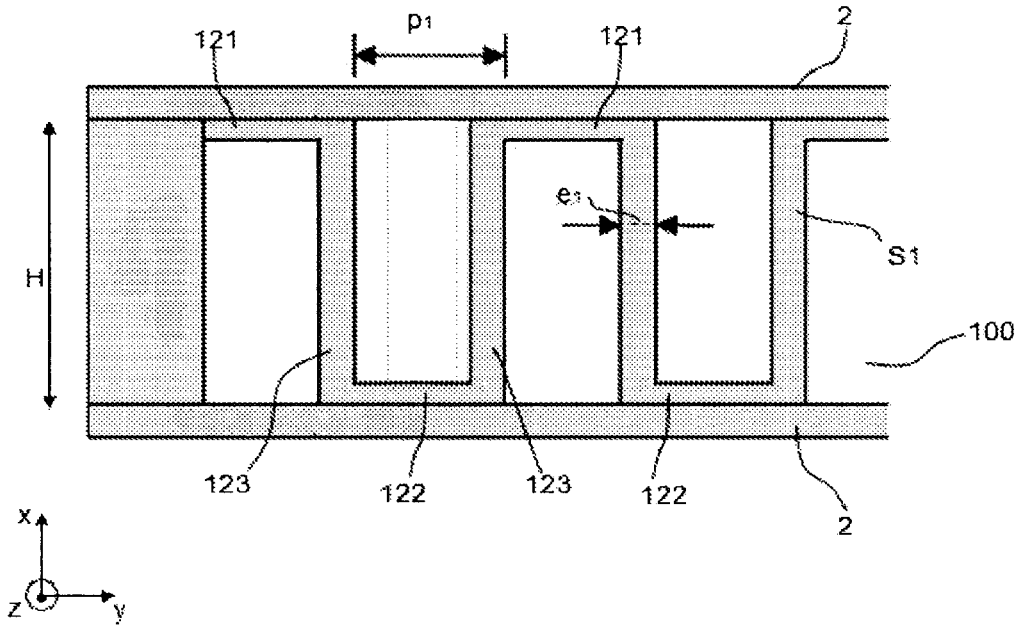
FIG. 7 shows a heat exchange structure of an exchanger according to one embodiment of the invention.
Figure 8:
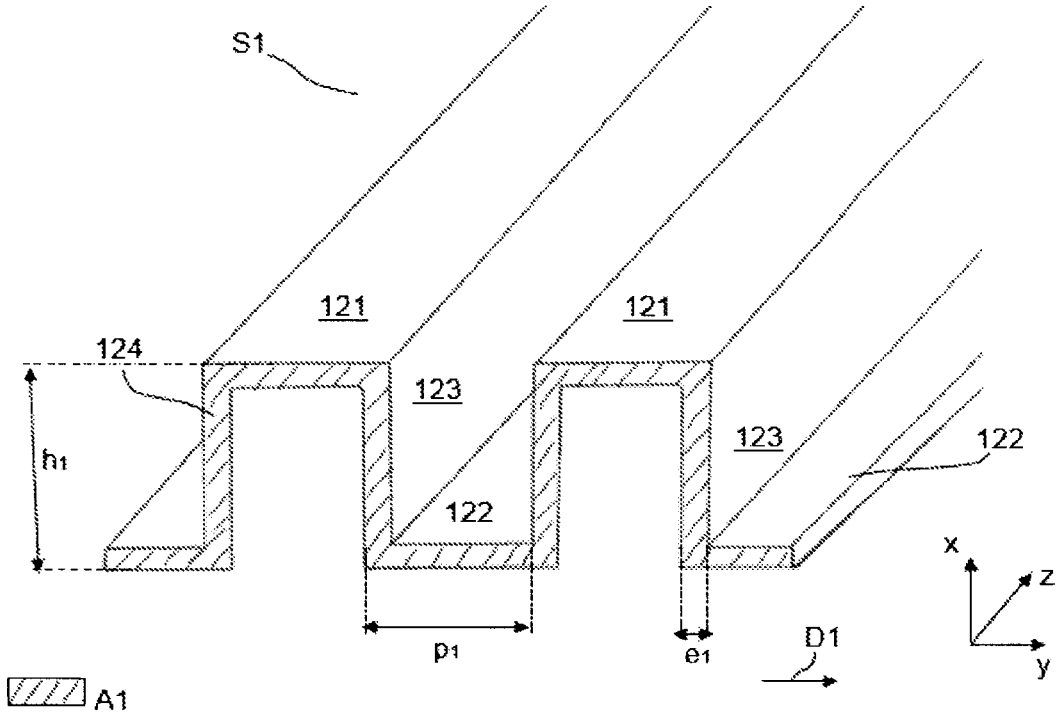
FIG. 8 shows a heat exchange structure of an exchanger according to another embodiment of the invention.

FIG. 7 and FIG. 8 show an example of a first heat exchange structure S1 that can be arranged in the first portion 100. The first structure S1 comprises at least one series of first fluid guiding walls 121, 122, 123 that have first leading edges 124 disposed substantially orthogonally to the longitudinal direction z and entirely or partially facing the first refrigerant fluid F1 when it flows in the first portion 100. Said walls are preferably arranged parallel to the longitudinal direction z. Said series preferably succeed one another in the longitudinal direction z.

A single series of first fluid guiding walls 121, 122, 123 is visible in FIG. 8. The first walls have a first thickness e1, measured in a plane orthogonal to the longitudinal direction z and following a direction orthogonal to the walls. The first structure has a first height h1, measured in a stacking direction x which is orthogonal to the longitudinal direction z and orthogonal to the plates 2.

The second heat exchange structure S2 comprises at least one series of second fluid guiding walls 221, 222, 223 that have second leading edges 224 disposed substantially orthogonally to the longitudinal direction z and entirely or partially facing the second refrigerant fluid F2 when it flows in the second portion 200.

Figure 10:
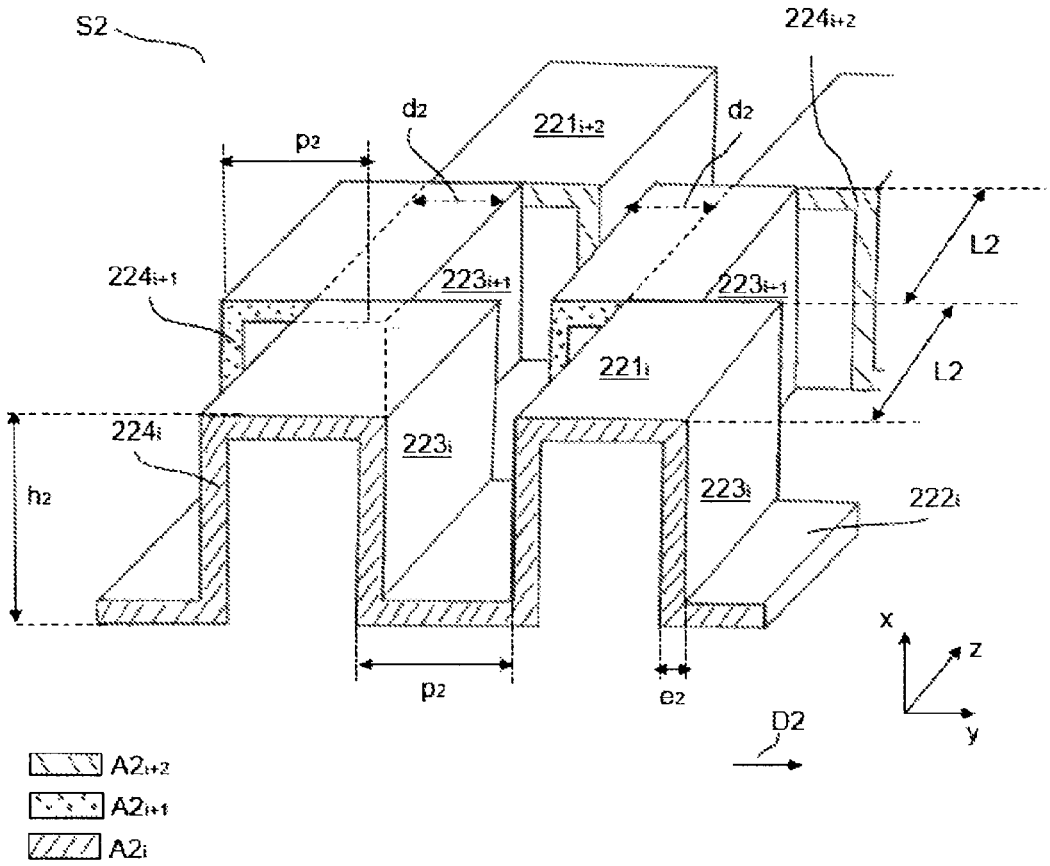
FIG. 10 shows a heat exchange structure of an exchanger according to another embodiment of the invention.

FIG. 10 shows one embodiment of a second exchange structure S2. The second fluid guiding walls 221, 222, 223 have a second thickness e2, measured in a plane orthogonal to the longitudinal direction z and following a direction orthogonal to the walls. The second heat exchange structure has a second height h2 measured in the stacking direction x.

The first and second fluid guiding walls preferably extend parallel to the longitudinal direction z. They may further be arranged parallel or orthogonally to the plates 2.

The heights h1, h2 of the structures S1, S2 are preferably substantially equal to or very slightly smaller than the height H of the passage 10.

According to the invention, the second heat exchange structure S2 and the first heat exchange structure S1 are shaped such that the cross-sectional area A2 of the second leading edges 224 is greater than the cross-sectional area A1 of the first leading edges 124. The cross-sectional areas A1, A2 are measured orthogonally to the longitudinal direction z and per meter of exchanger length. Determining the cross-sectional areas A1, A2 per unit of exchanger length makes it possible to eliminate possible differences in length between the first portion 100 and the second portion 200.

The arrangement of exchange structures having various leading-edge cross-sectional areas makes it possible to compensate for disparities in pressure losses to which the various refrigerant fluids are subject.

Thus, in the case of a first refrigerant fluid F1 circulating in its portion 100 dedicated to an operating pressure which is relatively low in relation to that of the refrigerant fluid(s) circulating in the other portions, the arrangement of a structure having a leading-edge area per unit of length that is smaller in the portion 100 makes it possible to bring about smaller pressure losses for the fluid F1. In the case of a second refrigerant fluid F2 circulating in its portion 200 dedicated to a pressure which is relatively high in relation to that of the refrigerant fluid(s) circulating in the other portions, the arrangement of a less-dense structure in the portion 100 makes it possible to bring about larger pressure losses for the fluid F2.

The exchanger according to the invention makes it possible to regulate the pressure losses to a reasonable level in each passage portion dedicated to a given refrigerant fluid. The energy performance of the industrial facility in which the exchanger according to the invention is incorporated is improved.

This also makes it possible to have sufficiently high fluid flow velocities in each passage portion. This results in a more uniform distribution of the refrigerant fluids and an improvement in the performance of the exchanger. The exchanger may thus be dimensioned with reduced safety margins in relation to the margins that would have to be provided if there were no structures according to the invention.

Moreover, the exchanger may operate in what is known as reduced operation, that is to say with lower flow rates, whether this is in a regime of temporary operation or in a steady state.

The cross-sectional area A2 of the second leading edges 224 preferably corresponds to the cross-sectional area A1 of the first leading edges 124 multiplied by a coefficient at least equal to 1.3, more preferably still between 1.5 and 5.

Such a multiplying coefficient makes it possible to efficiently balance the pressure losses to which the refrigerant fluids F1, F2 are subject, in particular when the refrigerant fluid F1 flows in the exchanger at a first pressure P1 and the second refrigerant fluid F2 flows in the exchanger at a second pressure P2 that is greater than the first pressure P1 by a factor of preferably between 2 and 7.

Advantageously, the first and the second exchange structures S1, S2 are exchange waves and respectively comprise at least a first corrugation and at least a second corrugation each comprising a plurality of fins, or wave legs, 123, 223 that succeed one another in the width of the exchanger in a lateral direction y which is orthogonal to the longitudinal direction z and parallel to the plates 2. The wave peaks 121, 221, 321 and the wave troughs 122, 222, 322 alternately connect said fins 123, 223. The first and second corrugations have corrugation directions D1, D2 parallel to the lateral direction y.

The fins 123, 223 preferably succeed one another periodically with a first and a second pitch p1, p2 between two successive fins. To express the pitches p1 and p2 of the first and second corrugations, it is possible to use the relationships p1=25.4/n1 and p2=25.4/n2, where n1 and n2 respectively are the number of fins 123, 223 per inch, 1 inch being equal to 25.4 millimeters, of the first and second corrugations as measured in the lateral direction y.

According to one embodiment of the invention, the first and second corrugations respectively have a first pitch p1 and a second pitch p2 that is smaller than the first pitch p1.

In other words, the second heat exchange structure S2 is configured so as to have a fin density that is greater than the fin density of the first heat exchange structure S1.

For example, it will be understood that arranging a greater number of fins in the width of the second portion 200 than in the width of the first portion tends to increase the leading-edge cross-sectional area encountered by the second fluid F2 and therefore to increase the pressure losses for the fluid F2.

According to another embodiment, as an alternative or in addition to the preceding embodiment, in the second portion 200 there are disposed second fluid guiding walls 221, 222, 223 having a second thickness e2 which is greater than the first thickness e1 of the first fluid guiding walls 121, 122, 123 arranged in the first portion 100. Increasing the thickness of the guiding walls of the second structure is another way of increasing the cross-sectional area of the leading edges that are present in the second portion 200.

Preferably, the first fluid guiding walls 121, 122, 123 form at least a first corrugation formed from a first strip and the second fluid guiding walls 221, 222, 223 form at least a second corrugation formed from a second strip respectively, said second strip having a thickness e2 which is greater than the first thickness e1 of the first strip. It will be understood that the structure S1 and/or the structure S2 may themselves comprise sub-portions, each sub-portion forming a separate entity. Typically, the structure S1 and/or the structure S2 may each comprise multiple wave pads arranged end to end and assembled in the passage by brazing.

As waves for the heat exchange structures S1, S2, use may be made of various types of waves usually implemented in brazed plate-fin exchangers. The waves may be selected from among the known types of wave, such as straight waves, serrated (partially offset) waves or herringbone waves. These waves may be perforated or not perforated.

FIG. 8 shows a first structure S1 made in the shape of a straight wave. A straight wave comprises a single series of first fluid guiding walls forming a single first corrugation over the length of the first portion 100.

Figure 9:
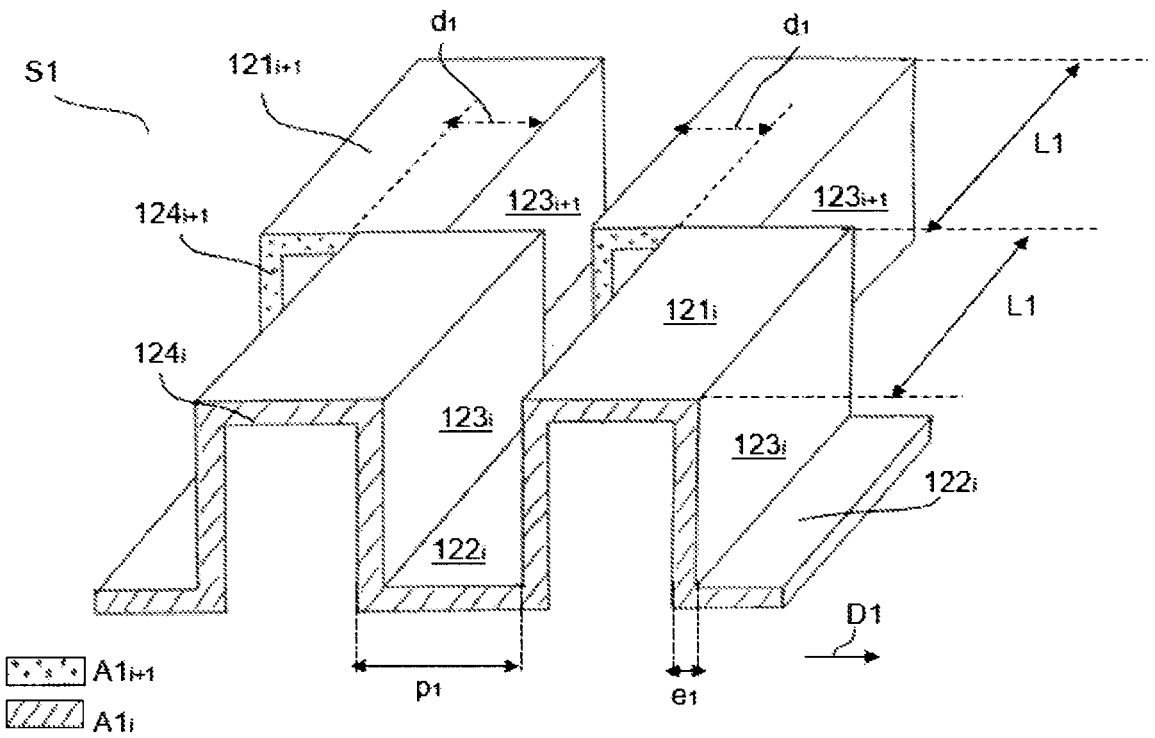
FIG. 9 shows a heat exchange structure of an exchanger according to another embodiment of the invention.

According to another embodiment, illustrated by FIG. 9 and FIG. 10, the first and second heat exchange structures S1, S2 are serrated (partially offset) waves.

The second heat exchange structure S2 comprises multiple series of second fluid guiding walls 221*i*, 222*i*, 223*i*, 221*i*+1, 222*i*+1, 223*i*+1, 221*i*+2, 222*i*+2, 223*i*+2 which succeed one another in the longitudinal direction z and each of which forms a second corrugation.

Each second corrugation is offset by a predetermined second distance d2, in the lateral direction y, in relation to an adjacent second corrugation. The second corrugations have a second serration length L2 measured in the longitudinal direction z.

In the case of a serrated (partially offset) wave, the cross-sectional area A2 of the second leading edges corresponds to the sum of the cross-sectional areas A2*i*, A2*i*+1, A2*i*+2, measured orthogonally to the longitudinal direction z and expressed per meter of exchanger length, of the second leading edges 224*i*, 224*i*+1, 224*i*+2 of each series of second fluid guiding walls.

With reference to FIG. 9, the description above can be reapplied to a first heat exchange structure S1 in the form of a serrated (partially offset) wave.

In the context of the invention, the first heat exchange structure S1 and/or the second heat exchange structure S2 may be serrated (partially offset).

In particular, it would be possible to arrange a straight wave S1 in the first portion 100 and a serrated (partially offset) wave S2 in the second portion 200. The addition of offsets in the second portion tends to increase the leading-edge area in the second portion.

Thus, in addition to or instead of varying at least one characteristic dimension, such as thickness, wave pitch, serration length, etc. of first and second structures S1, S2 of the same type, it is also possible to vary the wave type between the two portions 100, 200 to balance the pressure losses to which the refrigerant fluids are subject in these two portions.

According to a particular embodiment, the first heat exchange structure S1 and the second heat exchange structure S2 are serrated (partially offset) waves. Advantageously, the second serration length L2 is smaller than the first serration length L1. This makes it possible to arrange more leading edges per meter of exchanger length and therefore to increase the leading-edge cross-sectional area and the resulting pressure losses on the fluid that flows facing these leading edges.

Preference will be given to selecting a second serration length L2 that is smaller than the first serration length L1 by a factor of between 1.7 and 7. The first and/or second serration length(s) may be between 1 and 20 mm, preferably between 3 and 15 mm.

Except for the serration lengths, the characteristic dimensions of the waves, such as offset distances, thickness, corrugation pitch, etc., are preferably identical for the first and second structures.

With reference to FIG. 8, FIG. 9 or FIG. 10, note that for a given heat exchange structure S1 or S2 comprising fluid guiding walls of thickness e1 or e2 forming at least a first corrugation of pitch p1 or p2, of height h1 or h2, it is possible to define the cross-sectional areas A1, A2 per meter of exchanger length using the following relationships:

$$A1 = \frac{(h1 \times e1) + [(p1 - e1) \times e1]}{p1} \times Ly \times K1 \quad \text{Math 1}$$

$$A2 = \frac{(h2 \times e2) + [(p2 - e2) \times e2]}{p2} \times Ly \times K2 \quad \text{Math 2}$$

where y is the width of the refrigerant fluid passage 10, measured in the lateral direction y, and K1 or K2 is equal to 1 in the event of the heat exchange structure S1 or S2 being a straight wave, that is to say the fluid guiding walls of which form a single corrugation, without offset, or K1=1000/L1 or K2=1000/L2 in the event of the heat exchange structure S1 or S2 being a serrated (partially offset) wave with multiple offset corrugations, where L1 or L2 are the serration lengths expressed in millimeters for S1 or S2.

For example, for a serrated (partially offset) wave S2 referred to as "⅛" serrated" (1"=1 inch=25.4 mm), it follows that L2=25.4/8=3.18 mm. For a serrated (partially offset) wave S1 referred to as "⅕" serrated" (1"=1 inch=25.4 mm), it follows that L1=25.4/5=5.08 mm.

Figure 4:
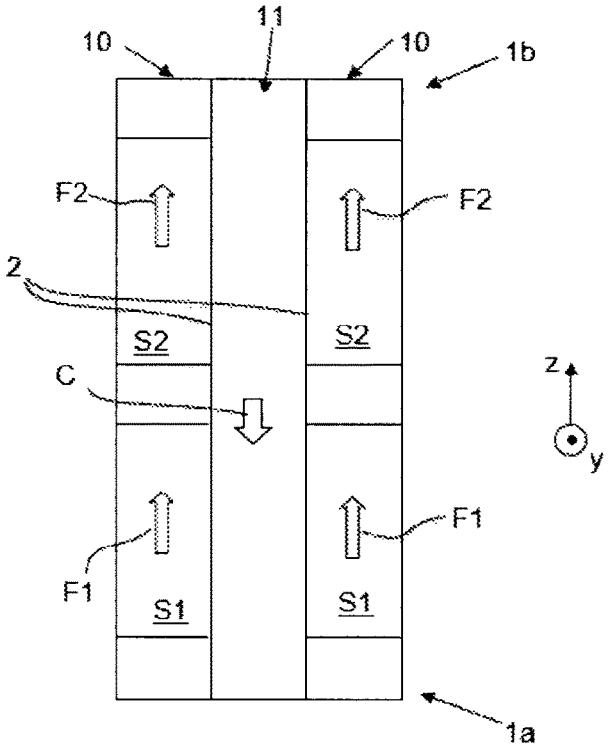
FIG. 4 is a schematic sectional view, in a plane orthogonal to the plates and parallel to the longitudinal direction of the exchanger, of series of passages of the heat exchanger of FIG. 3.

An exchanger according to one embodiment of the invention is shown in FIG. 3 and FIG. 4.

A heating passage 11 of the second series is visible in FIG. 4, two cooling passages 10 of the first series being arranged on either side of the passage 11. It is specified that the cooling and heating passages are not necessarily positioned in alternation and that other arrangements are possible.

The exchanger comprises distribution members 51, 61, 52, 62 which extend from and toward the passage inlets and outlets. These members, for example distribution waves or channels, are configured for managing and providing uniform distribution and recovery of the fluids over the entire width of the passages.

The structures S1, S2, etc. preferably extend following the width and the length of the passage 10, parallel to the plates 2, in line with the distribution members 51, 61, 52, 62 following the length of the passage 10. Each portion 100, 200, etc. of the passage 10 thus has a main part of its length constituting the actual heat exchange zone A1, A2, fitted with structures S1, S2, which is bordered by distribution zones fitted with the members 51, 61, 52, 62.

Advantageously, the distribution members and the heat exchange structures S1, S2 form, within the passage 10, a plurality of channels fluidly connecting the inlet 31 and outlet 41 to each other and the second inlet 32 and outlet 42 to each other.

Said first inlet, second inlet, first outlet and second outlet 31, 41, 32, 42 are preferably arranged such that the second portion 200 is arranged downstream of the first portion 100 in the longitudinal direction z, the first refrigerant fluid F1 and the second refrigerant fluid F2 flowing generally in the longitudinal direction z.

Advantageously, the exchanger comprises a first end 1*a* at which, during operation, the temperature level is the lowest of the exchanger, and a second end 1*b* at which, during operation, the temperature level is the highest of the exchanger. Expressed differently, the first end 1*a* corresponds to the cold end of the exchanger E1, that is to say the point of entry into the exchanger where a refrigerant fluid is introduced with the lowest temperature of all the temperatures of the exchanger E1. The second end 1*b* corresponds to the hot end of the exchanger E1, that is to say the end having the point of entry into the exchanger where a calorigenic fluid is introduced with the highest temperature of all the temperatures of the exchanger E1.

The second end 1*b* is preferably arranged downstream of the first end 1*a* in the longitudinal direction z, such that the flow direction of the fluids F1, F2 in the passage 10 is generally rising.

Preferably, the portion 100 for the flow of the refrigerant fluid F1 is arranged by the first end 1*a* and the second portion 200 for the flow of the second refrigerant fluid F2 is arranged between the portion 100 and the second end 1*b*.

Thus, in the illustration given in FIG. 3, the second portion 200 extends, in the longitudinal direction z, downstream of the portion 100.

The portions 100, 200 are preferably juxtaposed in the longitudinal direction z, which makes it possible to best optimize the space inside the passage 10 by maximizing the extent of the active zones.

Preferably, the majority, more preferably still at least 80%, of the total number of passages 10 of the first series, or even all of the passages 10 of the first series, each comprise at least one inlet 31 and one outlet 41 for the refrigerant fluid F1, at least a second inlet 32 and a second outlet 42 for the second refrigerant fluid F2, and first and second structures S1, S2 according to the invention.

Advantageously, the exchanger according to the invention has a single type of refrigerant fluid passage 10, which greatly simplifies the design. What is meant by passages of the same type are passages that have an identical configuration or structure, in particular in terms of passage dimensions, dispositions of the fluid inlets and outlets.

Preferably, the majority, preferably at least 80%, or even all, of the total number of passages 10 of the first series have an identical configuration. In particular, the inlets and outlets 31, 41, 32, 42 are arranged at substantially identical positions in the longitudinal direction z.

Thus, the inlets and outlets 31, 41, 32, 42 of the passages 10 of the first series are disposed in coincidence, the former above the latter, in the stacking direction x of the passages. The inlets 31, 32 and outlets 41, 42 thus placed the former above the latter are respectively joined at manifolds 71, 72, 81, 82 of semi-tubular shape, through which the fluids are distributed and discharged.

Preferably, the longitudinal direction is vertical when the exchanger is in operation. The refrigerant fluids F1, F2 flow generally vertically and in a rising direction. The calorigenic fluid C preferably circulates in countercurrent. Other flow directions for the fluids F1, F2 are of course conceivable, without departing from the scope of the present invention.

Figure 6:
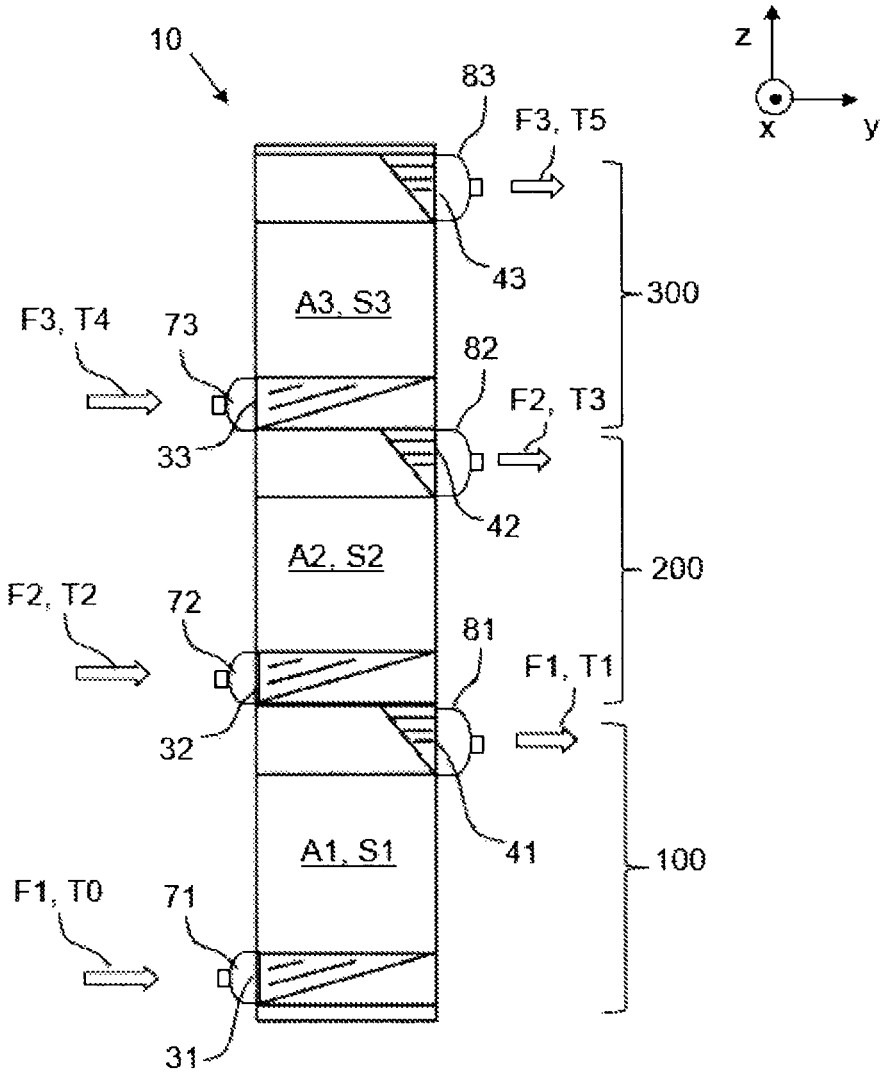
FIG. 6 is a schematic sectional view, in a plane parallel to the plates of the exchanger, of a passage of a heat exchanger according to another embodiment of the invention.

According to a variant embodiment, illustrated in FIG. 6, a second and a third refrigerant fluid F2, F3 flow in one and the same passage 10 in accordance with the invention.

In this case, at least one cooling passage 10 of the first series comprises a second and a third inlet 32, 33 which are configured to introduce respectively a second and a third refrigerant fluid F2, F3 into a respective second and a respective third portion 200, 300 of the passage 10, and a second and a third outlet 42, 43 which are configured to discharge respectively the second and third refrigerant fluids F2, F3 of the second and third portions 200, 300. The passage 10 is divided, in the longitudinal direction z, into three successive portions 100, 200, 300 comprising a first, a second and a third heat exchange structure S1, S2, S3.

The third heat exchange structure S3 comprises at least one series of third fluid guiding walls 321, 322, 323 arranged parallel to the longitudinal direction z and having third leading edges 324 disposed substantially orthogonally to the longitudinal direction z and entirely or partially facing the third refrigerant fluid F3 when it flows in the third portion 300.

The third heat exchange structure S3 and the first heat exchange structure S1 are shaped such that the cross-sectional area A3 of the third leading edges 224 is greater than the cross-sectional area A1 of the first leading edges 124. A3 is measured orthogonally to the longitudinal direction z and per meter of exchanger length.

The cross-sectional area A3 of the third leading edges 324 is preferably also greater than the cross-sectional area A2 of the second leading edges 224 of the second heat exchange structure S2.

The features and embodiments described above are applicable in whole or in part to the third structure S3 and are not repeated here for the sake of conciseness.

In the examples illustrated, the number of refrigerant fluids of different types is limited to 2 or 3 for the sake of simplification, it being noted that a greater number of fluid types could circulate in the at least one passage 10 according to the principles described above.

The partial cooling streams are preferably expanded to pressure values which increase in the longitudinal direction z, i.e. in the direction of the hot end 1*a*.

The lowest expansion level pressure value is preferably between 1.1 and 2.5 bar. The highest expansion level pressure value is between 10 and 20 bar. There may be at least one intermediate pressure level with an expansion pressure value of between 4.5 and 7.5 bar.

The refrigerant fluids originating from the expansions of the expanded partial streams preferably have temperatures which increase in the longitudinal direction z, i.e. in the direction of the hot end 1*a*. These temperatures correspond to the temperatures of introduction at the respective inlets 31, 32, 33, etc. into the exchanger E1. The refrigerant fluid F1 originating from the expansion to the lowest pressure level preferably has a temperature of between −80 and −60° C. The refrigerant fluid F3 originating from the expansion to the highest pressure level has a temperature of between −20 and 10° C. There may be at least one intermediate expansion level with a refrigerant fluid F2 at a temperature of between −50 and −25° C. The temperatures of the refrigerant fluids at the respective outlets 41, 42, 43 may be between −10 and 60° C., 20 and −45° C. and/or −20 and −75° C., respectively for the expansion levels described above.

Optionally, apart from the heat exchange structures described above, in the second and/or third portions 200, 300 there could be arranged at least one additional wave, specifically in a configuration referred to as "hardway", that is to say that the fins of the additional wave extend in a direction perpendicular to the longitudinal direction z and succeed one another in the longitudinal direction z. This makes it possible to introduce more pressure losses into a given portion. Said additional wave will preferably be a perforated straight wave or a serrated (partially offset) wave. Said additional wave will occupy only a part of the second and/or third portions 200, 300.

Advantageously, when the exchanger is in operation, the first refrigerant fluid F1 enters via the first inlet 31 of at least one passage 10 at a temperature referred to as initial temperature T0 and is discharged via the first outlet 41 at a first temperature T1 which is higher than T0. Preferably, the temperature T0 is between −55 and −75° C. and the temperature T1 is between −10 and −30° C.

Preferably, the second refrigerant fluid F2 enters the passage 10 via the second inlet 32 at a second temperature T2 and exits via the second outlet 42 at a third temperature T3, T3 being higher than T2. Preferably, the temperature T2 is between −15 and −35° C. and the temperature T3 is between 35 and 0° C.

The second temperature T2 is preferably lower than the first temperature T1. This makes it possible to provide a fluid F1 that is superheated when it exits the first portion 100 of the exchanger (T1 is high), whilst still effectively cooling down the calorigenic fluid in the second portion 200 of the exchanger by virtue of a low enough (lower than T1) vaporization start temperature, T2, of the fluid F2.

More preferably still, the second temperature T2 is at least 1° C. lower than the first temperature T1. Preferably, the second temperature T2 is at most 15° C., more preferably still at most 10° C., and preferentially at most 5° C. lower than the first temperature T1. This is in order to avoid excessive mechanical stresses in the exchanger.

Consideration will now be given to the variant in which a second and a third refrigerant fluid F2, F3 flow in one and the same passage 10.

Advantageously, when the exchanger is in operation, the refrigerant fluid F1 enters via the inlet 31 of at least one passage 10 at an initial temperature T0 of between −55 and −75° C. and is discharged via the outlet 41 at a first temperature T1 which is higher than T0, T1 being between −25 et −45° C.

Preferably, the second refrigerant fluid F2 enters the passage 10 via a first second inlet 32 at a second temperature T2 and exits it via the second outlet 42 at a temperature T3, T3 being higher than T2. Preferably, the temperature T2 is between −30 and −50° C. and the temperature T3 is between 0 and −20° C.

Preferably, the third refrigerant fluid F3 enters the passage 10 via a third inlet 33 at a fourth temperature T4 and exits it via a third outlet 43 at a fifth temperature T5, T5 being higher than T4. Preferably, the temperature T4 is between −5 and −25° C. and the temperature T5 is between 30 and 0° C.

Advantageously, the fourth temperature T4 is lower than the third temperature T3. This makes it possible to provide a fluid F2 that is superheated when it exits the portion 200 of the exchanger (T3 is high), whilst still effectively cooling down the calorigenic fluid in the third portion 300 of the exchanger by virtue of a low enough (lower than T3) vaporization start temperature, T4, of the fluid F3.

Preferably, the fourth temperature T4 is at least 1° C. lower than the third temperature T3.

Preferably, the second temperature T2 is at most 15° C., more preferably still at most 10° C., and preferentially at most 5° C. lower than the first temperature T1.

Advantageously, the fourth temperature T4 is at least 1° C. lower than the third temperature T3, preferably the fourth temperature T4 is at most 15° C. lower than the third temperature T3, more preferably still, in order to avoid excessive mechanical stresses in the exchanger, at most 10° C., and preferentially at most 5° C., lower than the third temperature T4.

According to a particular embodiment, the refrigerant fluids F1, F2 and/or F3, etc. are fluids that have different pressures, preferably pressures that increase in the longitudinal direction z. In particular, the refrigerant fluid F1 flows in the exchanger at a first pressure P1 and the second refrigerant fluid F2 flows in the exchanger at a second pressure P2 which is preferably higher than the first pressure P1. The fluids F1, F2 and/or F3, etc. may have the same composition. The third fluid F3 preferably has a third pressure P3 which is higher than the second pressure P2 of the second fluid F2.

An exchanger according to the invention may be used in any method implementing multiple refrigerant fluids of different types, in particular in terms of composition and/or characteristics such as pressure, temperature, physical state, etc.

The use of an exchanger according to the invention is particularly advantageous in a method for liquefying a stream of hydrocarbons such as natural gas. An example of such a method is partially schematically depicted in FIG. 11.

Figure 11:
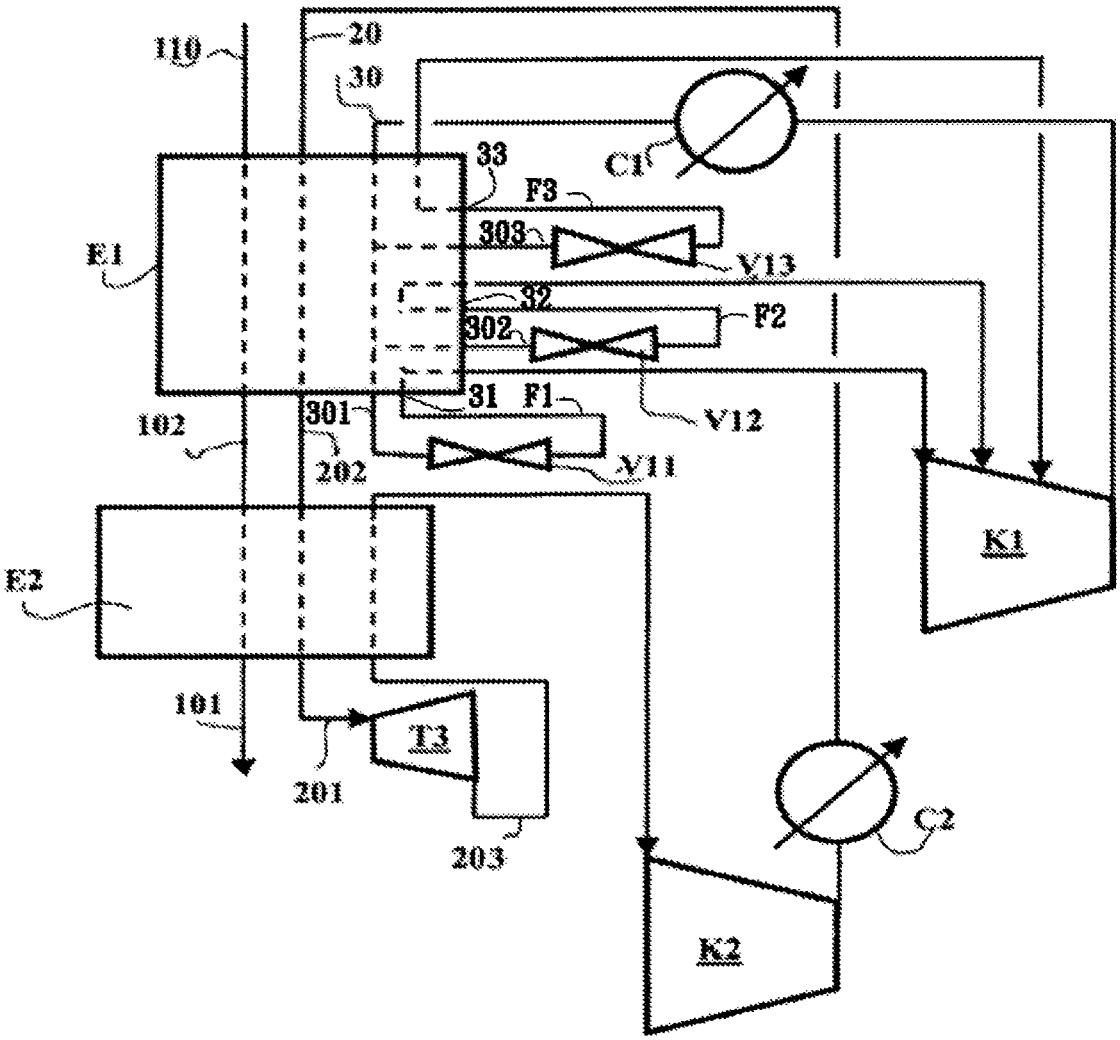
FIG. 11 schematically depicts one embodiment of a heat exchange method implementing an exchanger according to one embodiment of the invention.

According to the natural gas liquefying method schematically depicted in FIG. 11, the natural gas, forming the calorigenic fluid C, arrives via the duct 110 for example at a pressure of between 4 MPa and 7 MPa and at a temperature of between 30° C. and 60° C. The natural gas circulating in the duct 110 and the first cooling stream 30 enter the exchanger E1, possibly with a second circulating cooling stream 202, so as to circulate there in directions parallel to and concurrently with the calorigenic fluid C.

The natural gas exits the exchanger E1 via the duct 102 in a cooled-down state, or even at least partially liquefied state, for example at a temperature of between −35° C. and −70° C. The second cooling stream exits the exchanger E1 via the duct 202 in a completely condensed state, for example at a temperature of between −35° C. and −70° C.

In the exchanger E1, three fractions, also referred to as partial cooling streams or flow rates, 301, 302, 303 of the first cooling stream in the liquid phase are successively withdrawn. The fractions are expanded through the expansion valves V11, V12 and V13 to three different pressure levels, forming a refrigerant fluid F1, a second refrigerant fluid F2 and a third refrigerant fluid F3. These three refrigerant fluids F1, F2, F3 of different types are reintroduced into the exchanger E1 having cooling passages provided with three separate inlets 31, 32, 33 in accordance with the invention, and then at least partially, preferably completely, vaporized through exchange of heat with the natural gas, the second cooling stream and some of the first cooling stream.

Note that the expansions give rise to multiple refrigerant fluids in the biphasic state, that is to say having a liquid phase and a gas phase. According to one possibility, the biphasic fluids may each be introduced into a phase separator member arranged downstream of each expansion member. The separator member may be any device suitable for separating a biphasic fluid into a gas stream, on the one hand, and a liquid stream, on the other hand. The gas phases may be recombined before being introduced into the exchanger, or else introduced separately into the exchanger via separate inlets and then mixed together within the exchanger, by means of a mixer device as described for example in FR-A-2563620 or WO-A-2018172644. These devices are typically machined parts comprising a particular arrangement of separate channels for a liquid phase and a gas phase and orifices placing these channels in fluid communication in order to dispense a liquid-gas mixture.

According to another possibility, only the liquid phases separated from the biphasic refrigerant fluids are reintroduced into the exchanger E1 to be evaporated therein against the feed stream 110 and the first cooling stream 30. The gas phases are preferably diverted from the first exchanger E1, that is to say that they are not introduced into it. The liquid phases form said reintroduced biphasic refrigerant fluid portions.

Note that the biphasic fluids may optionally be directly reintroduced after expansion in the liquid-gas mixture state.

The three vaporized refrigerant fluids F1, F2, F3 are sent to various stages of the compressor K1, compressed and then condensed in the condenser C1 through exchange of heat with an external cooling fluid, for example water or air. The first cooling stream from the condenser C1 is sent into the exchanger E1 via the duct 30. The pressure of the first cooling stream at the outlet of the compressor K1 may be between 2 MPa and 6 MPa. The temperature of the first cooling stream at the outlet of the condenser C1 may be between 10° C. and 45° C.

The first cooling stream may be formed by a mixture of hydrocarbons, such as a mixture of ethane and propane, but may also contain methane, butane and/or pentane. The proportions, in mole fractions (%), of the components of the first cooling mixture may be:

Ethane: 30% to 70%
Propane: 30% to 70%
Butane: 0% to 20%

The natural gas circulating in the duct 102 may be fractionated, that is to say that a portion of the C2+ hydrocarbons containing at least two carbon atoms is separated from the natural gas using a device known to those skilled in the art. The fractionated natural gas is sent via the duct 102 into the exchanger E2. The collected C2+ hydrocarbons are sent into fractionating columns having a deethanizer. The light fraction collected at the top of the deethanizer may be mixed with the natural gas circulating in the duct 102. The liquid fraction collected at the bottom of the deethanizer is sent to a depropanizer.

According to an advantageous embodiment, illustrated in FIG. 11, the method according to the invention may further comprise at least one supplementary cooling cycle for the stream 102, performed downstream of the cycle described above.

Note that, generally, the terms "downstream" and "upstream" refer to the flow direction of the fluid under consideration, in the present instance the stream 110.

This cycle is implemented in a supplementary heat exchanger E2, generally referred to as liquefying exchanger, downstream of the first heat exchanger E1, in that case referred to as precooling exchanger.

The exchanger E2 may also be a plate exchanger. The cooled-down hydrocarbon stream 102 preferably enters the second exchanger E2 with the second cooling stream 202. The streams circulate in dedicated passages in directions parallel to the longitudinal direction z and concurrently.

The second cooling stream 201 exiting the exchanger E2 is expanded by the expansion member T3, which may be a turbine, a valve, or a combination of a turbine and a valve. The expanded second cooling stream 203 from T3 is sent into the exchanger E2 to be at least partially vaporized by countercurrent-cooling the natural gas and the second cooling stream.

At the outlet of the exchanger E2, the vaporized second cooling stream is compressed by the compressor K2 and then cooled down in the indirect heat exchanger C2 through exchange of heat with an external cooling fluid, for example water or air. The second cooling stream from the exchanger C2 is sent into the exchanger E1 via the duct 20. The pressure of the second cooling stream when it exits the compressor K2 may be between 2 MPa and 8 MPa. The temperature of the second cooling stream at the outlet of the exchanger C2 may be between 10° C. and 45° C.

In the method described by FIG. 11, the second cooling stream is not split into separate fractions, but, to optimize the approach in the exchanger E2, the second cooling stream may also be separated into two or three fractions, each fraction being expanded to a different pressure level and then sent to different stages of the compressor K2.

The second cooling stream is formed for example by a mixture of hydrocarbons and nitrogen, such as a mixture of methane, ethane and nitrogen, but may also contain propane and/or butane. The proportions, in mole fractions (%), of the components of the second cooling mixture may be:

Nitrogen: 0% to 10%;
Methane: 30% to 70%
Ethane: 30% to 70%
Propane: 0% to 10%

The natural gas exits the heat exchanger E2 in a liquefied state 101 at a temperature that is preferably at least 10° C. higher than the bubble point temperature of the liquefied natural gas produced at atmospheric pressure (the bubble point temperature denotes the temperature at which the first vapor bubbles form in a liquid natural gas at a given pressure) and at a pressure that is identical to the inlet pressure of the natural gas, except for pressure losses. For example, the natural gas exits the exchanger E2 at a temperature of between −105° C. and −145° C. and at a pressure of between 4 MPa and 7 MPa. Under these temperature and pressure conditions, the natural gas does not remain entirely liquid after expansion to atmospheric pressure.

Needless to say, the invention is not limited to the particular examples described and illustrated in the present patent application. Other variants or embodiments within the reach of those skilled in the art may also be envisaged without departing from the scope of the invention. For example, other configurations for injecting and extracting fluids into and from the exchanger, other flow directions of the fluids, other types of fluids, other types of heat exchange structures, etc. are of course conceivable, depending on the constraints stipulated by the method to be implemented.

The invention claimed is:

1. A heat exchanger comprising multiple plates which are mutually parallel and parallel to a longitudinal direction, said exchanger having a length measured in the longitudinal direction, said plates being stacked with spacing so as to define a first series of passages for the flow, in a general flow direction parallel to the longitudinal direction, of at least a first refrigerant fluid and a second refrigerant fluid, at least one passage of the first series being defined between two adjacent plates and comprising: at least a first inlet configured for introducing the first refrigerant fluid into a first portion of said passage and a first outlet configured for discharging the first refrigerant fluid from the first portion, at least a second inlet configured for introducing the second refrigerant fluid into a second portion of said passage and a second outlet configured for discharging the second refrigerant fluid from the second portion, said first inlet, second inlet, first outlet and second outlet being arranged such that said at least one passage of the first series is divided, in the longitudinal direction, into at least the first portion and the second portion, a first heat exchange structure arranged in the first portion and comprising at least one series of first fluid guiding walls having first leading edges extending orthogonally to the longitudinal direction so as to entirely or partially face the first refrigerant fluid when it flows in the first portion, a second heat exchange structure arranged in the second portion and comprising at least one series of second fluid guiding walls having second leading edges extending orthogonally to the longitudinal direction so as to entirely or partially face the second refrigerant fluid when it flows in the second portion, wherein the cross-sectional area of the second leading edges is greater than the cross-sectional area of the first leading edges, said cross-sectional areas being measured orthogonally to the longitudinal direction and per meter of exchanger length, wherein at least one series of first fluid guiding walls and said at least one series of second fluid guiding walls respectively form at least a first corrugation and at least a second corrugation, each comprising a plurality of fins succeeding one another in a lateral direction which is orthogonal to the longitudinal direction and parallel to the plates, with wave peaks and wave troughs alternately connecting said fins, wherein the first and second corrugations respectively have a first pitch (p1) and a second pitch (p2) smaller than the first pitch (p1), with p1=25.4/n1 and p2=25.4/n2, n1 and n2 respectively being the number of fins per inch of the first and second corrugations as measured in the lateral direction.

2. The exchanger as claimed in claim 1, wherein the cross-sectional area of the second leading edges corresponds to the cross-sectional area of the first leading edges multiplied by a coefficient at least equal to 1.3.

3. The exchanger as claimed in claim 1, wherein the first fluid guiding walls have a first thickness and the second fluid guiding walls have a second thickness, the second thickness being greater than the first thickness.

4. The exchanger as claimed in claim 1, wherein the second heat exchange structure comprises multiple series of second fluid guiding walls said series succeeding one another in the longitudinal direction and each forming a second corrugation having a corrugation direction parallel to the lateral direction, each second corrugation being offset by a predetermined second distance, in the lateral direction, in relation to an adjacent second corrugation, and having a second serration length in the longitudinal direction.

5. The exchanger as claimed in claim 1, wherein the first heat exchange structure comprises multiple series of first fluid guiding walls, said series succeeding one another in the longitudinal direction and each forming a first corrugation having a corrugation direction parallel to the lateral direction, each first corrugation being offset by a predetermined first distance, in the lateral direction, in relation to an adjacent first corrugation, and having a first serration length in the longitudinal direction.

6. The exchanger as claimed in claim 4, wherein the second serration length is less than the first serration length.

7. The exchanger as claimed in claim 1, wherein said first inlet, second inlet, first outlet and second outlet are arranged such that the second portion is arranged downstream of the first portion in the longitudinal direction, the first refrigerant fluid and the second refrigerant fluid flowing generally in the longitudinal direction.

8. The exchanger as claimed in claim 1, wherein said at least one passage of the first series further comprises a third inlet configured for introducing a third refrigerant fluid into a third portion of said passage and a third outlet configured for discharging the third refrigerant fluid from the third portion, said third inlets and third outlets being arranged such that said at least one passage of the first series is divided, in the longitudinal direction, into at least the first portion, the second portion and the third portion, the third portion comprising a third heat exchange structure comprising at least one series of third fluid guiding walls having third leading edges extending orthogonally to the longitudinal direction so as to entirely or partially face the third refrigerant fluid when it flows in the third portion, the total cross-sectional area of third leading edges being greater than the total cross-sectional area of second leading edges and/or greater than the total cross-sectional area of first leading edges, said total cross-sectional area being measured orthogonally to the longitudinal direction and per meter of exchanger length.

9. The exchanger as claimed in claim 8, wherein the third inlet and the third outlet are arranged such that the third portion is arranged downstream of the first portion and downstream of the second portion in the longitudinal direction, the third refrigerant fluid flowing generally in the longitudinal direction.

10. The exchanger as claimed in claim 1, wherein the second portion and/or the third portion comprise at least one additional corrugation having a plurality of fins that succeed one another in the longitudinal direction and extend orthogonally to the longitudinal direction.

* * * * *